United States Patent [19]

Saujet

[11] 4,371,087

[45] Feb. 1, 1983

[54] PACKAGE FOR PERFUME PRODUCTS

[75] Inventor: Claude Saujet, Saint-Maurice, France

[73] Assignee: Cartier International B.V., Amsterdam, Netherlands

[21] Appl. No.: 221,363

[22] Filed: Dec. 29, 1980

[30] Foreign Application Priority Data

Jan. 2, 1980 [FR] France ..... 80 00001

[51] Int. Cl.[3] ..... B65D 23/00; B65D 23/08

[52] U.S. Cl. ..... 215/12 R; 215/1 R

[58] Field of Search ..... 215/12 R, 12 A, 13 R, 215/1 R; 206/528, 530

[56] References Cited

U.S. PATENT DOCUMENTS

| | | | |
|---|---|---|---|
| 1,073,897 | 9/1913 | Goss | 215/12 R |
| 2,077,216 | 4/1937 | Conner | 215/13 R |
| 2,169,426 | 8/1939 | Morton | 215/13 R |
| 2,328,338 | 8/1943 | Hauptman | 215/12 R |
| 2,364,753 | 12/1944 | Richter | 215/12 R |
| 2,568,371 | 9/1951 | Seaver | 215/12 R |
| 2,710,109 | 6/1955 | Amann | 215/12 R |
| 2,808,090 | 10/1957 | Casalino | 215/12 R |
| 2,859,085 | 11/1958 | Morrison | 215/12 R |
| 2,889,065 | 6/1959 | Lawlor | 215/12 R |
| 3,080,989 | 3/1963 | Ramsbotham | 215/12 R |

FOREIGN PATENT DOCUMENTS

| | | | |
|---|---|---|---|
| 698167 | 11/1964 | Canada | 215/12 R |

*Primary Examiner*—William Price
*Assistant Examiner*—Sue A. Weaver
*Attorney, Agent, or Firm*—Cushman, Darby & Cushman

[57] ABSTRACT

A package is provided for liquids and in particular for perfumery products, characterized by the fact that it includes a case and a container, preferably of glass, the case receiving the container, and supporting it by its bottom, and by two lateral parts. The bottom of the receptacle has projecting downwardly, a locking element of the bayonet type which cooperates with an opening of corresponding shape in the case. The top of each of the lateral parts of the case has an abutment which cooperates with an abutment correspondingly placed on each side of the receptacle to delimit the angular position of this latter with respect to the case, between one position which permits engaging the bayonet in the case, and another position which corresponds to the use position of the package. An elastic arm placed along the height of each lateral part of the case cooperates with the projections on the container for, on the one hand guiding the receptacle toward it use position on the case by permitting the engagement of its bayonet type device, and on the other hand, holding the container elastically axially and in rotation on the case while the package is in the position of use.

12 Claims, 12 Drawing Figures

III
IV
V
VI
VII
VIII
XII

PACKAGE FOR PERFUME PRODUCTS

The present invention relates to a new package for liquids and in particular for perfumery products.

The packages for perfumery products have a double function, on one hand to provide a container or receptacle to hold the liquid which one desires to market, and on the other hand, to present it in an aesthetically attractive package which is not expensive while permitting a single use and one quick manipulation to use the package.

It thus results that packages for perfume products are generally expensive since it is necessary to add to the glassware portion which constitutes the container itself, a certain number of supplementary parts designed to give to the container the particular characteristics which are required.

The present invention has as its object to dissociate, in a package for perfume products, the packaging function itself which is ensured by a disposable glass container which performs the refill role, from the function of appearance or use, which is ensured by the addition of a durable case which can be made particularly attractive and carefully using noble materials.

Advantageously, with the device according to the invention the user first buys a case containing a container, then when the liquid contained in the container has been used he need only buy a refill constituted of the receptacle only, containing the perfume product, but which is separate from the case.

The advantage of this package resides in the fact that the refills which do not have any particular ornamentation are of a much lower cost and the case which is quite durable can have a higher cost of manufacture resulting from its more careful fabrication from more noble or costly materials.

The object of the present invention is a new package for liquids, in particular for perfumery products, characterized by the fact that is is constituted of a receptacle or container, preferably of glass, forming the refill and of a case destined to support the receptacle, a locking arrangement, such as a bayonet or a screw, projecting from the bottom of the container to engage in a corresponding cavity on the case in order to fasten the container to the case.

This characteristic of the locking device which projects from the lower part of the container has the advantage of permitting easy manufacture of the container by conventional glass making techniques, and assures that the refill is correctly used with the case with which it corresponds.

In one preferred embodiment of the invention the case has two lateral parts which frame the container up to its upper portion so as to protect it laterally and hold it along its length.

According to a particular embodiment of the invention, the package also includes a cap or cover which is placed on the top portion of the container to cover the stopper or the spray device which is located on the opening of the container.

In the form where the case has two lateral parts, the cover can advantageously be supported on the top of the two lateral parts to assure continuity of the case all around the container.

In a preferred embodiment of the invention the container has a generally rectangular section with small arcuately curved sides which comprise means for positioning with respect to the lateral parts of the case, which itself has approximately the same thickness as the receptacle.

In a particularly preferred embodiment of the invention the sides of the container, on the one hand, and the interior faces of the lateral parts of the case on the other hand, include positioning and guiding means which permit a good retention and support of the receptacle on the case, without play, in spite of the dimensional tolerances which are inherent in the manufacture of glass receptacles.

The present invention also has as object a package for liquids and in particular for perfumery products, characterized by the fact that it includes a case and a container, preferrably of glass, the case receiving the container, and supporting it by its bottom, and by two lateral parts, the bottom of the receptacle having projecting downwardly, a locking means of the bayonet type which cooperates with an opening of corresponding shape in the case, the top of each of the lateral parts of the case having an abutment which cooperates with an abutment correspondingly placed on each side of the receptacle to delimit the angular position of this latter with respect to the case, between one position which permits engaging the bayonet in the case, and another position which corresponds to the use position of the package; an elastic arm placed along the height of each lateral part of the case cooperating with the projections on the container for, on the one hand guiding the receptacle toward its use position on the case by permitting the engagement of its bayonet type device and, on the other hand, holding the container elastically axially and in rotation on the case while the package is in the position of use.

According to a preferred embodiment of the invention, the opening of the case which receives the bayonet type locking device which is located at the lower part of the receptacle, bears an elastic part made for example from a piece of deformable plastic material which acts on the locking device of the receptacle to push it constantly upwardly.

According to a preferred embodiment of the invention the angular displacement of the container with respect to the case is limited by the presence of a rib forming a projection on each side of the upper portion of the receptacle, the rib engaging in a recess along the height of and on the internal surface of each of the lateral parts of the case.

According to a preferred embodiment of the invention, each lateral part of the case includes a cam to assure the guidance and retention of the container, the cam which is mounted elastically in a manner to be withdrawn within the lateral part of the case, comprising, a first horizontal projection cooperating with a horizontal recess of the container in order to permit rotation of this latter, as well as two vertical parallel projections which cooperate with a projecting rib disposed at the center line of each of the vertical sides of the container.

The present invention also has for an object a refill container to be used for the packaging described above, this container being characterized by the fact that it includes adjacent its bottom a projection of the bayonet type able to engage in a corresponding fitting of the case.

In a preferred embodiment of the invention, the container includes on each side of its upper portion a projection destined to cooperate with the projections of the case in order to define the limits of angular displacement of the container with respect to the case.

According to a preferred embodiment of the invention, the container also includes on each of its sides a recess of horizontal shape and a median vertical rib which are destined to cooperate with a positioning and retaining device wich is located on each of the lateral sides of the case.

For the purpose of clarifying the invention one embodiment will now be described by way of a non-limiting example shown on the attached drawings.

Figures 1, 2, 3, 4, 5, 6, 7:
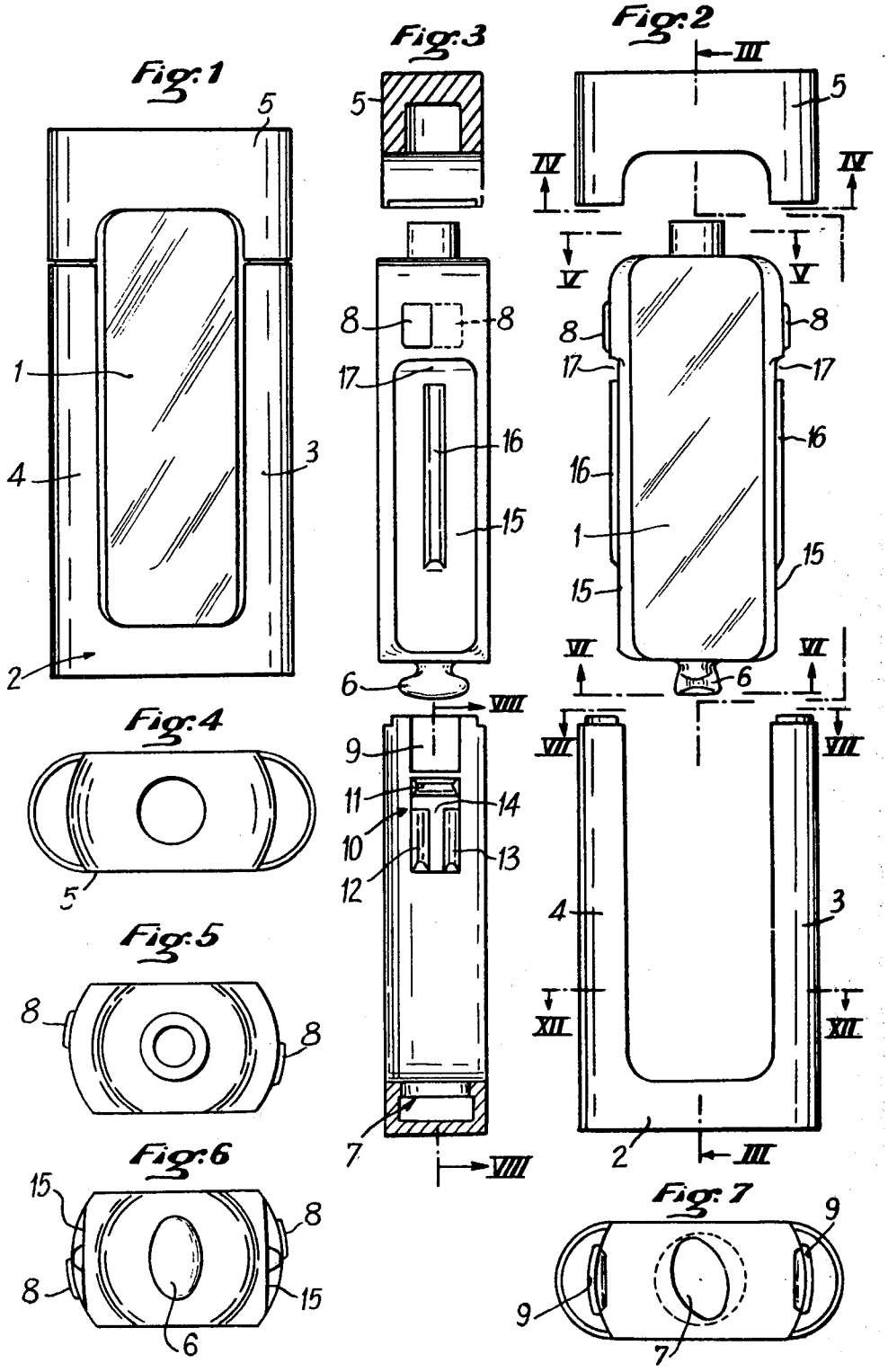
FIG. 1 is an elevational view of a package according to the invention.
FIG. 2 is a view corresponding to FIG. 1 but on which the case, the container and the cover are shown separated.
FIG. 3 is a sectional view along the line III—III of FIG. 2.
FIG. 4 is a bottom view of the cover along the line IV—IV of FIG. 2.
FIG. 5 is a top view of the container along the line V—V of FIG. 2.
FIG. 6 is a bottom view of the container along the line VI—VI of FIG. 2.
FIG. 7 is a top view of the case along the line VII—VII of FIG. 2.

As is clearly seen on the drawings and particularly on FIGS. 1 to 7, one embodiment of the package according to the invention includes a container 1, preferably made of glass, a case 2 which in the present case includes two lateral parts designed to frame or encase receptacle 1 and a cover which comes down on top of the receptacle and connects lateral parts 3 and 4. The bottom of receptacle 1 has a bayonet fastening means 6 which projects downwardly. This fastening means is able to engage in an opening 7 made in the interior of case 2 which has a shape corresponding to that of bayonet fastening means 6 as may be seen by comparing FIGS. 6 and 7.

As will be seen on FIG. 7, opening 7 is slightly inclined with respect to the direction of the transverse axis of the package, this inclination determining the inclination which the receptacle must take when it is to be engaged in the case.

The lower portion of the opening 7 advantageously has a part of deformable plastic material which constantly pushes receptacle 1 upwardly.

On each of its sides, along a portion of its height, receptacle 1 has a projection 8 which projects with respect to the circular contour of the receptacle as may be seen in particular on FIG. 5.

These projections 8 cooperate with recesses or grooves 9 which are formed in the upper portions of the internal surfaces of lateral parts 3 and 4 of the case. Recesses 9 of the case and projections 8 of the container are shown on a larger scale on FIGS. 11 and 12.

Figure 10:
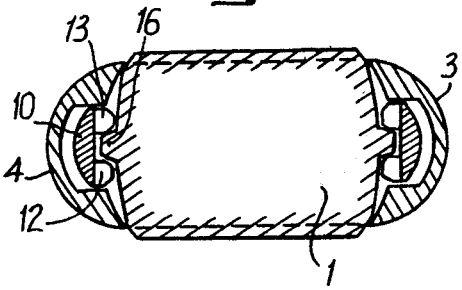

It will be clearly seen on FIG. 10 how the rotation of container 1 with respect to lateral parts 3 and 4 of the case is limited in the position of use, and how container 1 can be rotated in the direction of the arrow to take the position of engagement of bayonet device 6 in case 2.

Figure 11:
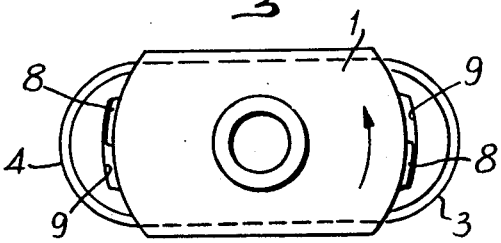
FIG. 11 is a top view of the case including the container.
Figure 12:
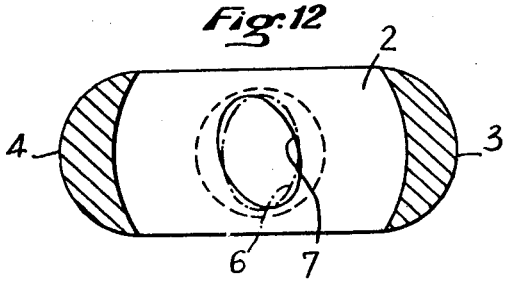
FIG. 12 is a view in section on an enlarged scale along the line XII—XIII of FIG. 2.

In FIG. 12, the solid lines show the opening 7 disposed in the base of case 2, and the broken lines show the contour of bayonet device 6 when receptacle 1 is in the position of use which corresponds to that shown on FIG. 11.

Figure 8:
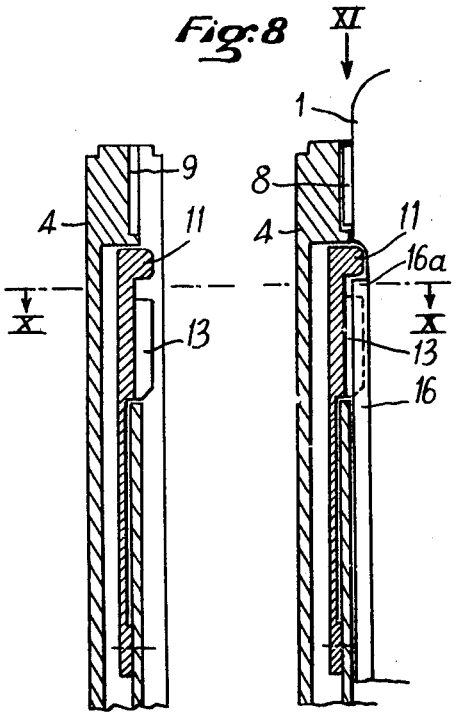
FIG. 8 is a partial view in section on an enlarged scale along the line VIII—VIII of FIG. 3 with and without the container.

FIGS. 3 and 8 clearly show the shape of elastic cam or arm 10 which is placed on each side inside lateral parts 3 and 4 of the case. This arm 10 has a first projection 11 disposed horizontally and two projections 12 and 13 parallel to each other and disposed vertically, these two latter projections leaving a passage 14 as may be seen in particular on FIG. 3.

As may be seen on FIGS. 2 and 3, the sides of container 1 are chamferred at 15 along the major part of their height, but not at their upper portions which bear projections 8.

The bottom view of FIG. 6 of receptacle 1 clearly shows the shape of chamfers 15.

The container also has on each side a rib 16 which projects vertically from the middle of each of the chamfers 15. The dimensions of rib 16 are such that it can be placed between projections 12 and 13 of elastic arm 10.

Space 17 which is located laterally on each side of the receptacle between the upper end of rib 16 and the end of chamber 15 forms a seat or recess for horizontal projection 11 of elastic arm 10.

Figure 9:
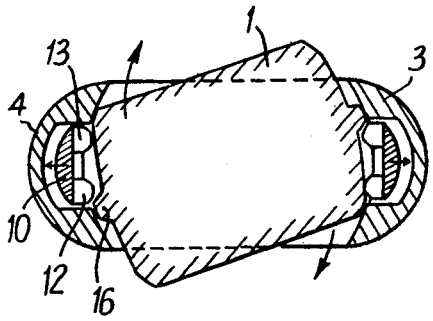
FIGS. 9 and 10 are cross sectional views on an enlarged scale along the line X—X of FIG. 8, of the two positions of maximum angular displacement of the container.

FIG. 9 shows how container 1 is guided vertically when it is introduced from the top between the two lateral parts 3 and 4 of the case.

Actually, as may be seen on FIG. 9, rib 16 which is located on the side of container 1 presses against the end of projection 12 of arm 10. Container 1 can then be engaged, when positioned angularly in this direction, which corresponds to the positioning of projection 8 in recess 9 of the device, with maximum angular displacement.

In this way bayonet device 6 of the receptacle can be engaged in opening 7 of the case. Then when the container is rotated in the direction of the arrow on FIG. 9, rib 16 comes to rest between the two projections 12 and 13 of elastic arm 10 and the upper part of rib 16 seats against horizontal projection 11 of arm 10, this projection 11 then being located in opening 17 of receptacle 1. It has been shown schematically on a larger scale on FIG. 8 how projection 11 seats against the upper part 16 a of vertical rib 16 which is also held laterally by the two vertical projections 12 and 13.

It will be seen under these conditions how container 1 is fastened to the case at its bottom by the bayonet device 6 while being pushed by the elastic means which is located inside opening 7 of the case.

It will also be seen how the upper portions of receptacle 1 are held elastically by the two elastic arms 10 which exert a positioning force vis a vis the rotational displacement because of projections 12 and 13 and which also maintain the receptacle in the upper portion because of the fact that the top part 16 a of flange 16 will seat against horizontal projection 11 of elastic arms 10.

In addition, the presence of the elastic arms 10 also assures guiding and very easy assembly of the refill container 1 in the case and this in spite of the differences due to the dimensional tolerances which are unavoidable in the manufacture of glass receptacles.

It is well understood that the embodiment which has been described above presents no limiting characteristics and may receive any desirable modifications without departing from the scope of the invention.

In particular it is evident that the shape of the arms and the projections which have been described could be modified to shapes assuring equivalent functioning.

Likewise, it goes without saying that the external appearance of the package could be different and notably that an embodiment of the package may be provided which does not include the cover 5.

I claim:

1. A package for liquids, particularly for perfumery products, comprising:

a case having a lower base portion and two lateral parts upwardly extending from said lower portion;

a refill container;

bayonet-type locking means for locking said container in the base of said case, said locking means comprising a projection extending from the bottom of said container, and an opening of a corresponding shape in said base portion for accommodating said projection; and means on said container and on the lateral parts of said case for:

(a) angularly positioning and vertically guiding the container during the introduction thereof into said case in a first angular orientation, in which said projection at the bottom of the container is in registration with and may be introduced into the opening of said base portion, and (b) elastically holding the container against axial and rotational displacement in said case in a second angular orientation in which said projection at the bottom of said container is locked in the opening of said base portion.

2. The package of claim 1, wherein:

said positioning, guiding and holding means comprises in each said lateral part of the case an arm mounted elastically so as to be able to withdraw within the respective lateral part of the case, each arm having a first projection cooperating with a horizontal recess of the container and two parallel vertical projections which cooperate with projecting ribs on each lateral side of the container.

3. The package of claim 1, further comprising:

in the opening of the base portion of the case, elastic means upwardly urging said projection of the bottom of said container when locked in said opening.

4. The package of claim 1, further comprising:

cooperating abutment means on the upper portion of each said lateral part of the case, and each side of the container to limit the angular displacement of this latter with respect to the case between said first and second angular orientations.

5. The package of claim 4, wherein: said abutment means comprises:

a projecting rib located on each side at the upper part of the container, said rib engaging in a recess near the top on the internal face of each of the lateral parts of the case.

6. The package of claim 1, wherein:

said two lateral parts of the case frame the container up to its upper portion; and further comprising:

a cover placed over the upper portion of the container and seating on the top of said two lateral parts of the case.

7. The package of claim 1, wherein:

the container is essentially rectangular in section with small arcuately curved sides which provide said positioning, guiding and holding means.

8. The package of claim 7, wherein:

the case and the container have substantially the same width.

9. A perfume package, comprising:

a case and a bottle disassociably associated therewith, said case comprising:

a body of generally U-shape as seen in front and rear elevation, including a centrally located generally horizontal base portion and two laterally-spaced lateral portions projecting upwardly at opposite ends of said base portion;

the base portion having a centrally located, upwardly opening socket formed therein, this socket having means defining a mouth of non-circular figure as seen in top plan view, this mouth having a first selected angular disposition relative to the width and depth of the case about a longitudinal axis of the case;

said two lateral portions having respective inner sidewalls, the two of which face one another over the base portion of the case, each said inner sidewall having a lower portion and an upper portion;

said inner sidewalls being generally cylindrically curved about said case longitudinal axis so as to have respective concave surface portions;

a respective keeper means associated rotationally medially with said inner sidewall lower portion of each said lateral portion of said case;

each such keeper means including a pair of radially inwardly projecting lugs spaced equally to the left and right of the median of the respective inner sidewall, and a third radially inwardly projecting lug spaced above said pair of lugs generally rotationally medially of the respective inner sidewall;

each such keeper means further including means resiliently urging all three respective lugs generally radially inwardly generally towards said case longitudinal axis, so each said three lugs normally projects radially further towards said case longitudinal axis than does the respective inner sidewall concave surface portion;

means rotationally at least generally centrally formed on each inner sidewall in the upper portion thereof, an inwardly and upwardly opening notch, said bottle being of generally rectangular form, and having opposed front and rear sidewalls in the form of two respective externally generally flat, at least largely transparent, relatively broad panels, two opposed relatively narrow end walls, a bottom wall and a top wall with a centrally located, axially upwardly projecting neck;

means defining a centrally located, axially downwardly projecting external boss on said bottle bottom wall;

each said bottle end wall having an upper portion and a lower portion;

both of said bottle end walls having extensive external surface portions of cylindrical curvature disposed coaxially with said neck and boss, each of these surface portions being present in narrow marginal bands at both angular extremes of said lower portion of each wall and over substantially all of the said upper portion of each end wall, but for where it is obscured by a respective angularly offset lug formed externally on such upper portion, each such lug being marginally perimetrically surrounded by the respective said surface portion of cylindrical curvature;

both of said lugs being angularly offset in the same rotational sense from the median of the respective end wall;

each bottle end wall further including in the lower portion thereof, an angularly centrally disposed radially relieved region having a vertically extending medially located rib formed externally thereon, each such rib projecting radially of the bottle no further than the respective external surface portion of cylindrical curvature;

said boss on said bottle bottom wall having a head of non-circular transverse cross-sectional figure which is effectively complementary to the non-circular figure of said case socket mouth, this head having a selected angular disposition rotationally of the bottle which is at least somewhat different from the comparable angular disposition of said case base socket mouth relative to said case longitudinal axis, the bottle being constructed and arranged to be disassociably associated with the case by inserting the bottle into the case bottom-first with the bottle rotationally cocked relative to the case so that the head of the boss on the bottom wall of the bottle is in rotational and axial registry with the case base socket mouth, projecting this boss axially into said socket through said mouth while receiving said bottle end wall lugs into said case lateral portion inner sidewall notches, then turning said bottle into registration with said case, thereby causing:

one lug of each said pair of lugs of each said keeper means to resiliently cam over said rib on the respective bottle end wall, the third lug of each said keeper means to become wedged between the upper end of the respective rib and the upper margin of said radially relieved region of the respective bottle end wall, said bottle bottom boss head to become locked in said case base recess, and each of said bottle generally front and rear sidewall panels to be closely framed along the bottom margin and both lateral margins thereof by said case.

10. A refill container for association with a case to provide a package for liquids, particularly for perfumery products, in which the package comprises:

a case having a lower base portion and two lateral parts upwardly extending from said lower portion;

a refill container;

bayonet-type locking means for locking said container in the base of said case, said locking means comprising a projection extending from the bottom of said container, and an opening of a corresponding shape in said base portion for accommodating said projection; and means on said container and on the lateral parts of said case for:

(a) angularly positioning and vertically guiding the container during the introduction thereof into said case in a first angular orientation, in which said projection at the bottom of the container is in registration with and may be introduced into the opening of said base portion, and (b) elastically holding the container against axial and rotational displacement in said case in a second angular orientation in which said projection at the bottom of said container is locked in the opening of said base portion;

said refill container comprising on its lower portion a bayonet-type of projection, and on each side, an upper recess, and a respective vertical median rib below each said recess.

11. The refill container of claim 10, comprising a further projection on each side on its upper portion.

12. A bottle constructed and arranged for disassociable association with a case to constitute a perfume package, where the case comprises:

a body of generally U-shape as seen in front and rear elevation, including a centrally located generally horizontal base portion and two laterally-spaced lateral portions projecting upwardly at opposite ends of said base portion;

the base portion having a centrally located, upwardly opening socket formed therein, this socket having means defining a mouth of non-circular figure as seen in top plan view, this mouth having a first selected angular disposition relative to the width and depth of the case about a longitudinal axis of the case;

said two lateral portions having respective inner sidewalls, the two of which face one another over the base portion of the case, each said inner sidewall having a lower portion and an upper portion;

said inner sidewalls being generally cylindrically curved about said case longitudinal axis so as to have respective concave surface portions;

a respective keeper means associated rotationally medially with said inner sidewall lower portion of each said lateral portion of said case;

each such keeper means including a pair of radially inwardly projecting lugs spaced equally to the left and right of the median of the respective inner sidewall, and a third radially inwardly projecting lug spaced above said pair of lugs generally rotationally medially of the respective inner sideall;

each such keeper means further including means resiliently urging all three respective lugs generally radially inwardly generally towards said case longitudinal axis, so each said three lugs normally projects radially further towards said case longitudinal axis than does the respective inner sidewall concave surface portion;

means rotationally at least generally centrally formed on each inner sideall in the upper portion thereof, an inwardly and upwardly opening notch, said bottle being of generally rectangular form, and having opposed front and rear sidewalls in the form of two respective externally generally flat, at least largely transparent, relatively broad panels, two opposed relatively narrow end walls, a bottom wall and a top wall with a centrally located, axially upwardly projecting neck;

means defining a centrally located, axially downwardly projecting external boss on said bottle bottom wall;

each said bottle end wall having an upper portion and a lower portion;

both of said bottle end walls having extensive external surface portions of cylindrical curvature disposed coaxially with said neck and boss, each of these surface portions being present in narrow marginal bands at both angular extremes of said lower portion of each end wall and over substantially all of the said upper portion of each end wall, but for where it is obscured by a respective angularly offset lug formed externally on such upper portion, each such lug being marginally perimetrically surrounded by the respective said surface portion of cylindrical curvature;

both of said lugs being angularly offset in the same rotational sense from the median of the respective end wall;

each bottle end wall further including in the lower portion thereof, an angularly centrally disposed radially relieved region having a vertically extending medially located rib formed externally thereon, each such rib projecting radially of the bottle no further than the respective external surface portion of cylindrical curvature;

said boss on said bottle bottom wall having a head of non-circular transverse cross-sectional figure which is effectively complementary to the non-circular figure of said case socket mouth, this head having a selected angular disposition rotationally of the bottle which is at least somewhat different from the comparable angular disposition of said case base socket mouth relative to said case longitudinal axis, the bottle being constructed and arranged to be disassociably associated with the case by inserting the bottle into the case bottom-first with the bottle rotationally cocked relative to the case so that the head of the boss on the bottom wall of the bottle is in rotational and axial registry with the case base socket mouth, projecting this boss axially into said socket through said mouth while receiving said bottle end wall lugs into said case lateral portion inner sidewall notches, then turning said bottle into registration with said case, thereby causing:

one lug of each said pair of lugs of each said keeper means to resiliently cam over said rib on the respective bottle end wall, the third lug of each said keeper means to become wedged between the upper end of the respective rib and the upper margin of said radially relieved region of the respective bottle end wall, said bottle bottom boss head to become locked in said case base recess, and each of said bottle generally front and rear sidewall panels to be closely framed along the bottom margin and both lateral margins thereof by said case.

* * * * *